US005480031A

United States Patent [19]

Maultasch et al.

[11] Patent Number: 5,480,031

[45] Date of Patent: Jan. 2, 1996

[54] COMBINED PIZZA BOX LID SUPPORT AND CUTTER

[76] Inventors: Jonathan Maultasch, 10 Dunster Rd., Great Neck, N.Y. 11021; Bruce Maultasch, 252 Forest Dr., Jericho, N.Y. 11753

[21] Appl. No.: 414,809

[22] Filed: Mar. 31, 1995

[51] Int. Cl.[6] ..... B65D 85/00; A45C 11/20

[52] U.S. Cl. ..... 206/525; 206/551; 206/542; 229/906; 426/115; 426/128; 30/319

[58] Field of Search ..... 206/525, 551, 206/542; 229/204, 906; 426/106, 112, 115, 129, 128, 132; 30/319, 307, 298.4

[56] References Cited

U.S. PATENT DOCUMENTS

| | | | |
|---|---|---|---|
| D. 184,088 | 12/1958 | Edgar . | |
| D. 221,291 | 4/1971 | Futter . | |
| D. 222,380 | 10/1971 | Fratioli, Jr. . | |
| D. 318,209 | 7/1991 | Boxman . | |
| 699,584 | 5/1902 | Smith . | |
| 4,441,626 | 4/1984 | Hall | 426/112 X |
| 4,498,586 | 2/1985 | Vitale | 206/525 |
| 4,700,843 | 10/1987 | Cohen | 206/521 |
| 4,738,028 | 4/1988 | Belokin et al. . | |
| 4,809,437 | 3/1989 | Saliaris . | |
| 4 877,609 | 10/1989 | Beck et al. | 206/525 X |
| 4,957,237 | 9/1990 | Madonna et al. | 229/906 X |
| 4,993,157 | 2/1991 | Wang . | |
| 5,002,221 | 3/1991 | Ragan . | |
| 5,077,050 | 12/1991 | Wall | 426/124 |
| 5,101,564 | 4/1992 | Melter | 30/319 |
| 5,110,038 | 5/1992 | Pantisano et al. | 206/551 X |
| 5,144,749 | 9/1992 | Chen | 30/319 |
| 5,211,329 | 5/1993 | Patton | 229/906 X |
| 5,263,634 | 11/1993 | Korine | 229/906 X |

*Primary Examiner*—Paul T. Sewell
*Assistant Examiner*—Tara L. Laster
*Attorney, Agent, or Firm*—Howson and Howson

[57] ABSTRACT

A package for carrying and transporting a pizza product or like food article in which a combination device is used both to support a top panel of the package and prevent it from contacting the pizza product and to slice the pizza product at the place of consumption.

20 Claims, 2 Drawing Sheets

10
14
3
3
12
18
20
22
24
28
30
30
28

10
30
26
18
12
16
20
22
24
28
30
32
30
28
32

COMBINED PIZZA BOX LID SUPPORT AND CUTTER

FIELD OF THE INVENTION

The present invention relates to receptacles for carrying and transporting prepared food products, and more particularly the present invention relates to a package for a pizza product including a pizza box and a plastic tool, the plastic tool being used to support the box lid from contacting the pizza and as a rotary pizza cutter.

Background of the Invention

It has become common practice for consumers to purchase food products fully prepared and to transport the food products to their residences, offices or other eating places. Alternatively, the fast food industry has made it commonplace for providing the service of delivering the fully prepared food directly to the customer wherever he or she may be. Such practices necessitate the use of receptacles for carrying and transporting the food products. The receptacles must maintain the food products in an undisturbed state and maintain the food product at its preferred temperature.

A receptacle used for pizza products is normally a rectangular cardboard box. The shape of pizzas requires the box to have a square top and bottom sides in plan view. The top and bottom sides are separated by peripheral sidewalls whose height is quite small in relation to the dimensions of the top and bottom sides.

The shape of the pizza box has the inherent problem that the center of the top lid may bow downward and contact the top of the pizza product. The heat of the pizza product also causes the lid to bow. The result is that the consumer is left with a food product in which half of the product may be stuck to the underside of the cardboard lid making the product unappealing.

To overcome the above-stated problem, it is customary in the art to use a plastic box support known as a so-called "pizza saver." The purpose of the pizza saver is to prevent the lid of the pizza box from contacting the pizza product contained in the pizza box. An example of such a pizza saver is shown in FIG. 5 of U.S. Pat. No. 5,002,221 issued to Ragan. Pizza saving devices generally have a flat top surface for engaging the lid of the pizza box and leg means extending from the top surface for contacting with the pizza product. Once the food product is consumed, the consumer generally discards both the pizza box and the pizza saver.

Another common problem with take-out or delivered pizza products is the process of separating individual slices of pizza from the remaining pizza products. While pizzas are generally sliced at the facility where they were prepared, the heat of the pizza product generally will cause the ingredients on the product, such as the cheese topping, to re-congeal, thereby requiring re-slicing once the product reaches its final destination. Rotary pizza cutters such as are disclosed in U.S. Pat. No. 4,809,437 issued to Saliaris and U.S. Design Pat. No. 318,209 issued to Boxman are handy tools for such a situation. However, these tools are not always readily available at every residence, office or place where a pizza may be consumed. The result is that often a consumer will merely separate the pizza product by pulling the slices apart frequently causing the toppings to be completely removed from the crust.

Although the aforementioned pizza packages, pizza savers, and rotary pizza cutters function satisfactorily for the intended purposes, there is a need for an improved package for carrying and transporting pizza products. The improved package should have means for preventing the pizza box lid from contacting the top of the pizza product as well as providing a means for re-slicing the pizza product at its place of consumption. The improved pizza package should be inexpensive to manufacture in commercial quantities so as not to add significantly to the price of the pizza product to the consuming public.

Objects of the Invention

With the foregoing in mind, a primary object of the present invention is to provide an improved pizza package including a pizza box and a tool for supporting the box as well as re-slicing the pizza product.

Another object of the present invention is to provide a plastic tool having the combined function of supporting the pizza box as well as re-slicing the pizza product.

A further object of the present invention is to provide a plastic combination device for acting as a pizza saver and as a rotary pizza cutter yet which can be manufactured at a minimum of cost.

Summary of the Invention

More specifically, the present invention provides a device for use with a pizza product in a pizza box. The device has a disc for preventing a top flap, or lid, of the pizza box from contacting the top side of a pizza product contained in the pizza box. The disc also has an outer peripheral edge forming a cutting surface.

The device has a shaft member extending transversely from the disc. A remote end of the shaft member is used to engage the pizza product while the disc supports the top flap of the pizza box.

A handle is connected to the shaft member. When the pizza product is to be consumed, the pizza can be re-sliced by manipulating the handle and using the outer peripheral edge of the disc as a rotary cutting tool to slice the pizza product.

BRIEF DESCRIPTION OF THE DRAWING

The foregoing and other objects, features and advantages of the present invention should become apparent in the following descriptions taken in conjunction with the accompanying drawings, in which.

DETAILED DESCRIPTION OF THE PREFERRED EMBODIMENT

Figure 1:
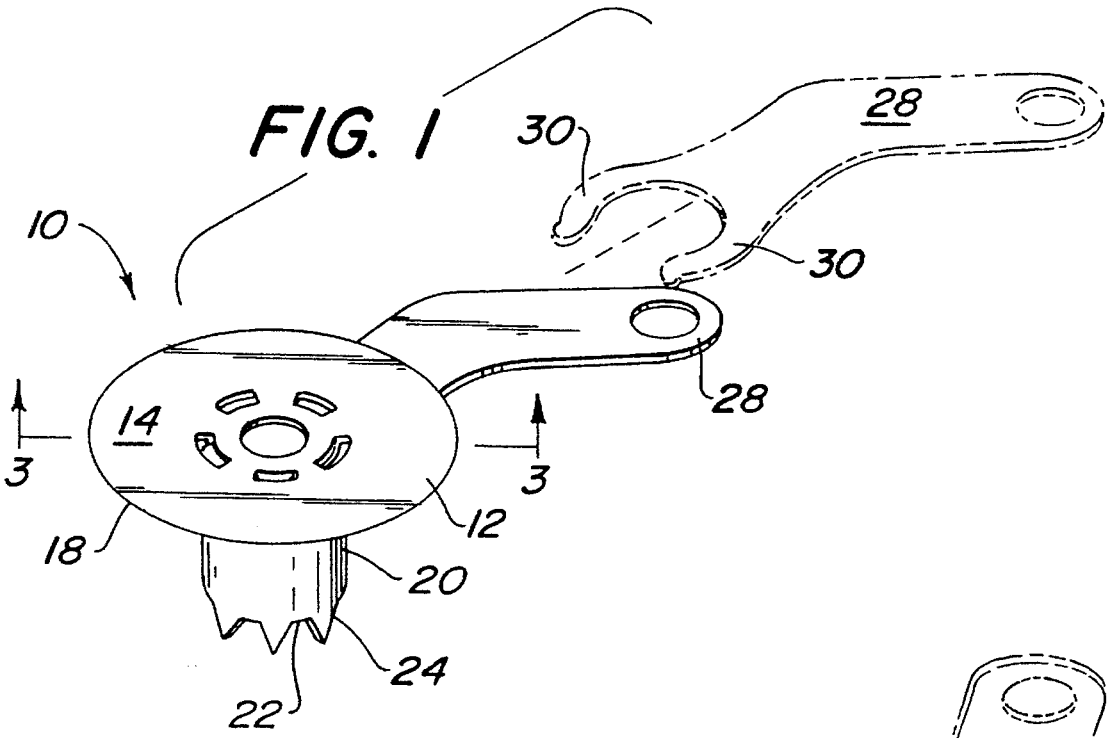
FIG. 1 is a perspective view of a combination device according to the present invention.

Referring now to the drawings, FIG. 1 illustrates a combined pizza box support and rotary cutting device 10. The device 10 can be made of plastic and used in a package for carrying and transporting pizza products and other like food products that require cutting prior to serving. The device 10 can initially be used with a pizza box to prevent the lid of the pizza box from contacting the top surface of the pizza while the package is in transit. In addition, the device 10 can later be used as a rotary cutting tool to slice the pizza or like food product.

The device 10 comprises a disc 12, a shaft member 20, and a handle 28.

The disc 12 provides a means for engaging the pizza box above the pizza product and a means for forming a rotary cutting device. The disc 12 has a front surface 14 which is flat to confront the underside of the lid of the pizza box when closed. In addition, the disc 12 has a rear surface 16 which is flat, and an outer peripheral edge 18 forming a cutting surface or blade.

The shaft member 20 extends transversely from the rear surface 16 of the disc 12. The shaft member 20 defines an axis of rotation about which the cutting blade 18 rotates. The shaft member 20 has a remote end 22 with a plurality of teeth 24. The teeth 24 engage the pizza product while the disc 12 engages the underside of the lid of the pizza box.

The handle 28 removably connects to the shaft member 20 and allows device 10 to be used as a rotary cutting tool. To this end, the handle 28 has projections 30 which form a yoke about the shaft member 20 to rotatably connect the handle 28 to the shaft member 20. This connection allows the disc 12 and shaft member 20 to rotate about the axis of rotation relative to handle 28. Alternatively, the device 10 could have a structure which permits the shaft member and handle to remain stationary while only the disc 12 rotates about an axis of rotation.

The structure of device 10 as disclosed above allows it to be used as a conventional pizza saver to prevent a lid of a pizza box from contacting the top of the pizza product contained in the pizza box. This may best be seen in FIG. 4 which illustrates a portion of a pizza product 34. The pizza product 34 has a top side 36 and a bottom side 38. The bottom side 38 of the pizza product 34 normally comprises a crust made from a dough product. The top side 36 of the pizza product 34 normally comprises tomato sauce, cheese, and any number of ingredients. If the lid of a package should contact the top side 36 of the pizza product 34, as in the course of delivery, the pizza product 34 would be less appetizing to the consumer.

Figure 4:
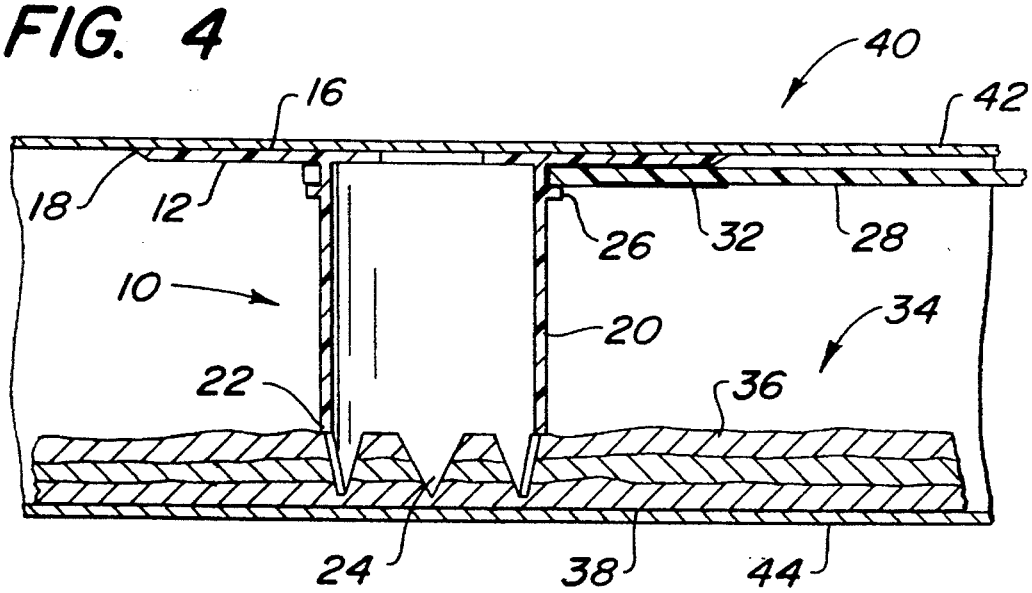
FIG. 4 is a cross-sectional view of the device shown in FIG. 3 taken along line 4—4, the view showing the device in use in a pizza box containing pizza.

FIG. 4 also illustrates a package 40 for carrying and transporting the pizza product 34. The package 40 includes a pizza box having a lid 42 which forms the top of the pizza box. The pizza product 34 rests on a bottom side 44 of package 40.

As shown in FIG. 4, the device 10 prevents the lid 42 of the package 40 from contacting the top side 36 of the pizza product 34. This is accomplished by front surface 14 of the disc 12 engaging the lid 42 in combination with the remote end 22 of the shaft member 20 engaging the pizza product 34. The handle 28 extends parallel to the lid 42 and does not interfere with the shape of the package 40 or with the function of supporting the box lid above the pizza.

If a conventional rotary pizza cutting tool is not available at the place of consumption of the pizza product, the device 10 can be used to slice the pizza and thereby overcomes the problem of slicing the pizza product after the pizza product has reached its final destination.

To this end, the handle 28 is grasped by the user and the outer peripheral edge 18 of the disc 12 is located on the pizza product where the pizza is to be sliced, generally at a previously sliced location that has partially reformed due to flowing of the ingredients across the cut line. The user applies pressure to the handle and moves the handle along the line of slice which causes the disc 12 to rotate and the outer peripheral edge 18 to slice the pizza. The handle 28 has a lengthwise-extending stiffening means 32 located on the handle to provide additional strength to the handle so that it will not snap under the hand pressure required to slice the pizza.

Figure 2:
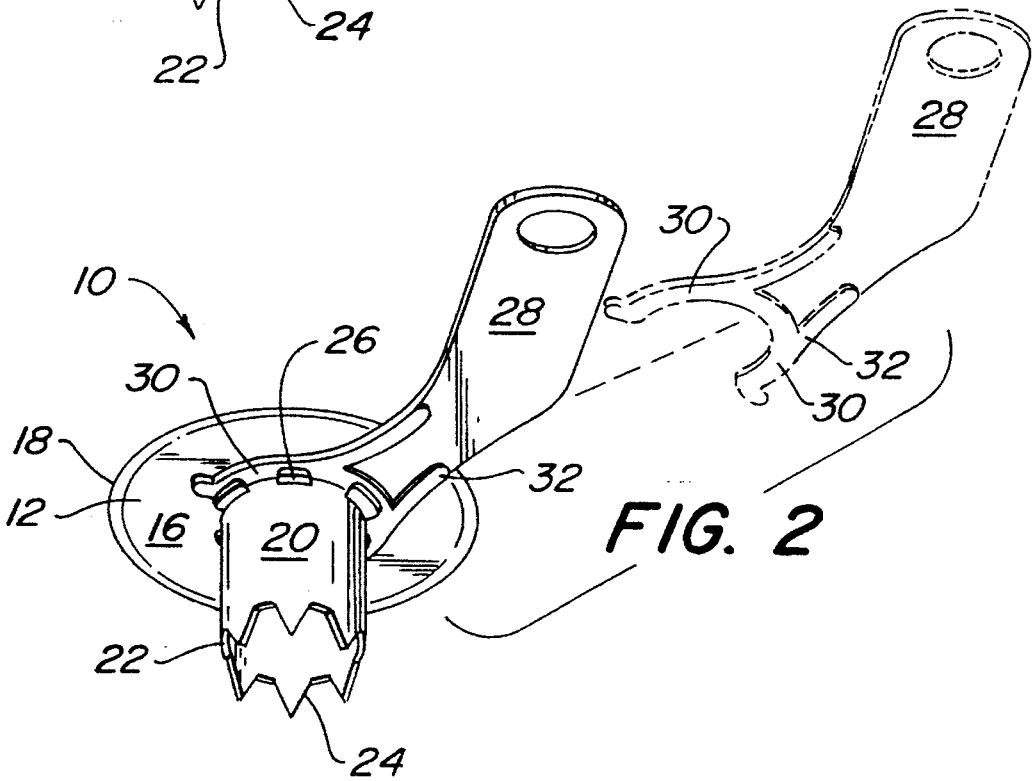
FIG. 2 is a perspective view of the underside of the device shown in FIG. 1.
Figure 3:
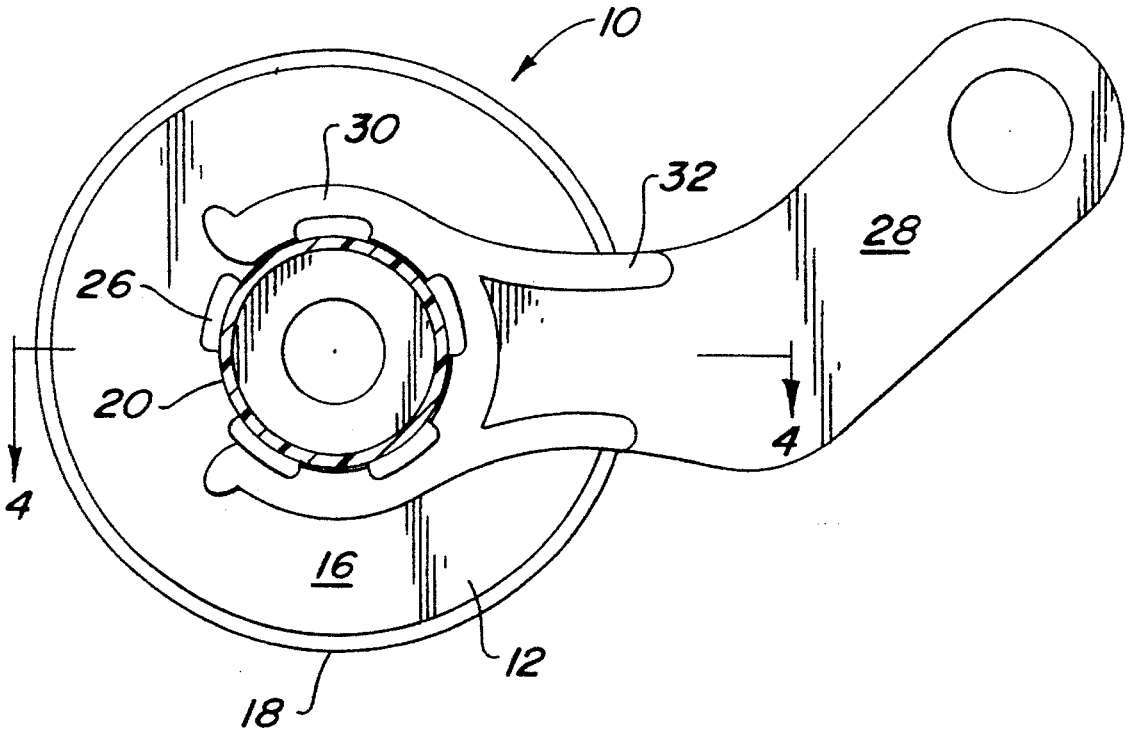
FIG. 3 is a rear plan view of the device of FIG. 1.

It is envisioned that the handle will have means for removably connecting to the shaft member 20 in order to reduce the cost of manufacture by enabling the handle 28 to be molded separately from the disc 12 and shaft members 20. As shown in FIGS. 1 and 2, the handle 28 snaps onto the shaft member 20 by utilizing a pair of projections 30 forming a yoke which girds, or substantially encircles a major portion of the shaft member 20. The projections 30 expand when they engage the shaft member 20 and elastically contract when fully engaged to provide a snap-fit engagement. To prevent the handle from lateral movement along shaft 20, the shaft member 20 is provided with a flange means 26. As seen in FIG. 2 and 3 the preferred flange means is provided by a series of short laterally extending flanges disposed closely adjacent the rear surface 16 of the disc 12 to form a journal, or groove. Alternatively, the flange means 26 could be one continuous flange, or could simply be provided by a continuous groove in a thickened shaft 20. The flange means 26 and the rear surface 16 of the disc 12 holds the handle in place.

The combined pizza box support and rotary cutting tool and its use with a pizza box provides a package which protects the pizza from being ruined and provides a ready means of slicing the pizza at the place of consumption.

While preferred embodiments of the present invention have been described in detail, various modifications, alterations, and changes may be made without departing from the spirit and scope of the invention as defined in the appended claims.

We claim:

1. A device for use with a pizza product in a pizza box, comprising:

a disc for engaging a top panel of the pizza box above the pizza product contained in the pizza box, said disc having an outer peripheral edge forming a cutting surface;

a shaft member extending transversely from said disc, said shaft member having an end remote from said disc for engaging the pizza product while said disc engages the top panel of the pizza box; and a handle connected to said shaft member;

whereby the device can be used both as a lid support and as a rotary cutting tool to slice the pizza product.

2. A device according to claim 1, wherein said handle is rotatably connected to said shaft member and wherein said shaft member is formed integrally with said disc.

3. A device according to claim 2, wherein said handle has a yoke portion formed integrally therewith for snap-fit into engagement in a groove formed in said shaft.

4. A device according to claim 3, wherein said handle is removably attached to said shaft member.

5. A device according to claim 4, wherein said remote end of said shaft member has a plurality of teeth for engaging the pizza product.

6. A device according to claim 5, wherein said disc has a flat front surface for engaging the underside of the pizza box top panel.

7. A device according to claim 6, wherein said shaft member has a flange means extending laterally from said shaft member for providing a groove preventing lateral movement of said handle on said shaft member.

8. A device according to claim 7, wherein said disc has a flat rear surface for cooperating with said flange means to provide said groove for holding said handle in place.

9. A combination device for preventing a top panel of a pizza box from contacting a pizza product contained therein, and for use as a rotary cutting tool to slice the pizza product at a point of consumption, comprising:

a disc having a front surface for engaging the top panel of the pizza box and an outer peripheral edge forming a cutting surface;

a shaft member extending transversely from said disc and defining an axis of rotation, said shaft member having an end remote from said disc for engaging the pizza product while said front surface of said disc engages the top panel of the pizza box; and a handle connected to said shaft member and extending laterally from said shaft member;

wherein hand pressure can be exerted on said handle and said handle manipulated to cause said disc to rotate relative to said axis of rotation for causing said cutting surface to engage and slice the pizza product.

10. A combination device according to claim 9, including means for removably connecting said handle to said shaft member.

11. A combination device according to claim 10, wherein said removable connecting means includes a yoke provided on said handle and a groove provided on said shaft member, said yoke encircling a major portion of the periphery of said groove.

12. A combination device according to claim 11, wherein said shaft member has at least one laterally extending flange disposed adjacent to said disc providing said groove for retaining said handle in place on said shaft member.

13. A combination device according to claim 12, wherein said handle has a pair of projections substantially encircling said shaft member to retain said handle on said shaft member, said projections expanding when engaged on said shaft member and elastically contracting when fully engaged to provide a snap-fit engagement.

14. A combination device according to claim 13, wherein said handle has lengthwise-extending stiffening means for structurally strengthening said handle against bending when used in the cutting mode of operation.

15. A package for pizza and like food products, comprising:

a box for containing the pizza product, said box having a lid for opening and closing the box; and a plastic tool for preventing said lid from contacting the pizza product and for providing a rotary cutter to slice the pizza product;

wherein said plastic tool has a disc with a front surface for engaging said lid and a peripheral outer edge forming a rotatable cutting blade;

wherein said plastic tool has a shaft member extending transversely from said disc and defining an axis of rotation, said shaft member having an end remote from said disc for engaging the pizza product while said front surface of said disc engages said lid; and wherein said plastic tool has a handle extending laterally from said shaft member for enabling hand pressure and motion to rotate said cutting blade on the pizza product to slice the pizza product.

16. A package according to claim 15, including means for removebly connecting said handle to said shaft member.

17. A package according to claim 16, wherein said removable connecting means includes a yoke provided on said handle and a groove provided on said shaft member, said yoke encircling a major portion of the periphery of said groove.

18. A package according to claim 17, wherein said shaft member has at least one laterally extending flange disposed adjacent to said disc providing said groove for retaining said handle in place on said shaft member.

19. A package according to claim 18, wherein said handle has a pair of projections girding said shaft member to retain said handle on said shaft member, said projections expanding when engaged on said shaft member and elastically contracting when fully engaged to provide a snap-fit engagement.

20. A package according to claim 19, wherein said handle has lengthwise-extending stiffening means for structurally strengthening said handle against bending when used in the cutting mode of operation.

* * * * *